US005704617A

United States Patent [19]

Stoughton et al.

[11] Patent Number: 5,704,617

[45] Date of Patent: Jan. 6, 1998

[54] IN-LINE SKATE BRAKE

[75] Inventors: Robert Smith Stoughton, Snowmass; Eduard Willem H. Oliemans, Aspen, both of Colo.

[73] Assignee: 99 Innovations, Inc., Aspen, Colo.

[21] Appl. No.: 455,530

[22] Filed: May 31, 1995

[51] Int. Cl.[6] ..... A63C 17/06; A63C 17/14

[52] U.S. Cl. ..... 280/11.2; 280/11.22; 188/24.14

[58] Field of Search ..... 280/11.2, 11.22; 188/17, 24.14, 26

[56] References Cited

U.S. PATENT DOCUMENTS

| | | | |
|---|---|---|---|
| 1,402,010 | 1/1922 | Ormiston . | |
| 1,497,224 | 6/1924 | Ormiston . | |
| 1,869,612 | 8/1932 | Padgett | 280/11.2 |
| 2,097,721 | 11/1937 | Cledina | 280/11.2 |
| 4,194,751 | 3/1980 | Shinmura | 280/11.2 |
| 4,281,468 | 8/1981 | Giese et al. . | |
| 5,183,292 | 2/1993 | Ragin, III . | |
| 5,211,409 | 5/1993 | Mitchell et al. . | |
| 5,226,673 | 7/1993 | Cech . | |
| 5,232,231 | 8/1993 | Carlsmith | 280/11.2 |
| 5,312,120 | 5/1994 | Wiegner | 280/11.2 |
| 5,351,974 | 10/1994 | Cech . | |
| 5,374,070 | 12/1994 | Pellegrini, Jr. et al. . | |
| 5,388,844 | 2/1995 | Pellegrini, Jr. et al. . | |
| 5,397,137 | 3/1995 | Pellegrini, Jr. et al. . | |
| 5,398,948 | 3/1995 | Mathis . | |

FOREIGN PATENT DOCUMENTS

| | | | |
|---|---|---|---|
| 2593713 | 4/1987 | France | 280/11.2 |

*Primary Examiner*—Brian L. Johnson
*Attorney, Agent, or Firm*—Sheridan Ross P.C.

[57] ABSTRACT

A drum brake design is applied to an in-line skate wheel having a circular braking surface located on an inner race. A brake shoe is pivotally mounted to a frame member. An activating end of the brake shoe is linked to the rotatable upper boot quarter. The skater activates the brake by rotating the upper boot quarter rearward. Alternate embodiments include multi-wheel brakes and a remote transmitter which activates a frame mounted electric actuator.

16 Claims, 10 Drawing Sheets

IN-LINE SKATE BRAKE

Cross Reference Patents

U.S. Pat. No. 4,281,468 (1981) to Giese et al. is incorporated herein by reference.

FIELD OF INVENTION

The present invention relates to braking mechanisms for controllably braking one or more wheels of an in-line skate.

BACKGROUND OF THE INVENTION

In-line skates are notoriously fast and hard to stop. Such skates are commonly used outside, on uneven sidewalks, hills, bicycle paths, and roads having traffic. Skaters can achieve high speeds and can become a hazard to themselves and others when skating more rapidly than conditions allow. There is a great need for an effective brake for in-line skating to become a sport that is safe as well as enjoyable.

A brake commonly used on in-line skates involves a fixed friction pad that extends behind the heel of the skate. The fixed friction pad is disposed above the skating surface and is made to swing down towards the skating surface by the skater's pivoting the skate about the axis of the rear wheel. As the skater does so, raising the toe of the skate and rotating the heel downward, the friction pad behind the heel will contact the ground and stop the skate. Such systems have also been used on tandem wheeled skates, and because the speeds are not so high, can involve a fixed friction pad that extends in front of the toe of the skate. In this case, the skater brings the friction pad to bear on the skating surface by raising the heel and lowering the toe.

Disadvantages of the physically activated, toe-raised (or lowered), brakes include these: (a) the braking maneuver requires the skater to place himself or herself in an awkward position balancing on one wheel and an unpredictable pad, and a skater's lack of dexterity or balance will make the maneuver difficult to perform, especially if the skater is moving at relatively high speed or encounters an unexpected hazard, (b) the braking maneuver requires the exercise of thigh muscle strength, and a skater's fatigue will make the maneuver more difficult to perform, and (c) such brakes can only be used on one skate, effectively halving the potential stopping force available.

It may be said, in general, that an inexperienced skater finds it very intimidating to move his or her foot through such a large arc that he or she must jeopardize their balance in order to apply the brake. This has made many potentially new skaters reluctant to take up the sport at all.

There has been much interest in attempting to solve the problems of toe-raised (or lowered) brakes so as to make in-line skating a sport that can be enjoyed by other than the young, the fit, or the reckless. Current attempts to do so have been directed towards replacing the physically-activated brake with a mechanically activated device. There have been attempts to mount a caliper or disc brake adjacent to the side or tread of one of the wheels of the skate. A hand lever-and-cable system can be used by the skater to apply friction pressure to the side or to the tread of the wheel, and the skate can be made to stop without the need for special body movement by a skater.

Other efforts at stopping skates are noted below.

U.S. Pat. No. 5,183,292 (1993) to Ragin, III discloses a detachable brake and protector for an in-line skate while in use walking and not skating.

U.S. Pat. No. 5,211,409 (1993) to Mitchell et al. discloses an in-line skate brake assembly having a ground pad. The pad is hinged to the skate frame and activated by a hand held cable.

U.S. Pat. No. 5,226,673 (1993) to Cech discloses a hub brake assembly for an in-line skate. The wheel has an indented wear surface. A circular brake pad is urged laterally against the wear surface by a hand held cable. This design requires lots of parts in addition to an unwieldy set of cables.

U.S. Pat. No. 5,351,974 (1994) to Cech discloses a band type brake for an in-line skate. A brake pad is affixed to a contractible annular support. A hand grip controller is used in conjunction with a cable to squeeze the brake pad against an internal hub.

U.S. Pat. No. 5,374,070 (1994) to Pellegrini, Jr. et al. discloses in FIG. 4 a boot mounted rod/ground pad brake assembly. Pivoting the boot extends the ground pad into the skating surface. The device is for in-line skates.

U.S. Pat. No. 5,388,844 (1995) to Pellegrini, Jr. et al. discloses a boot mounted rod which pushes on a scissor-like linkage to activate a disk type brake.

U.S. Pat. No. 5,397,137 (1995) to Pellegrini, Jr. et al. discloses a boot mounted rod/ground pad brake assembly for an in-line skate.

U.S. Pat. No. 5,398,948 (1995) to Mathis discloses an in-line skate damping mechanism.

U.S. Pat. No. 1,497,224 (1924) to Ormiston discloses a roller skate brake having a brake band (15) disposed around the wheel hub (9). An ankle strap pulls on a linkage which tightens the brake band around the hub.

U.S. Pat. No. 1,402,010 (1922) to Ormiston disclosed a metal brake shoe that rubs on the outer surface of a roller skate wheel. The brake shoe is activated by an ankle strap and linkage.

Braking systems that rely on bringing a pad into contact with the skating surface are noisy, and provide an uneven and jerky braking force when the skating surface is rough. The noise is undesirable, and the jerkiness can make the skate difficult to control.

Of all the known prior art, the simplest approach appears to be taught by Cech and Pellegrini, Jr. et al. '844. These patents teach braking one wheel on each skate via rubbing surfaces inside the wheel hub. Thus, at least one wheel on each skate is used for stopping. This offers simplicity and control by keeping all skate wheels in contact with the ground during braking and using the same smooth wear surface for braking regardless of the skating surface.

The present invention improves upon the known technology by using a drum type brake on a skate wheel. Automobiles use the same drum type brakes on a much larger size wheel. An inner circumference of the wheel hub assembly provides a braking surface. A brake pad is urged against the braking surface by a linkage to the hinged upper boot quarter.

This design is especially appealing for large two wheeled skates. With large wheels there exists more ground contact for the braking wheel. With large wheels, large brake pads are feasible inside the hub of the wheel.

In summary, the present invention for the first time applies the proven technology of automobile drum type brakes to in-line skates.

SUMMARY OF THE INVENTION

The primary object of the present invention is to provide a drum type brake on an in-line skate wheel, thus providing a smooth and even braking force to the skate even when skating on rough surfaces.

Another object of the present invention is to actuate the brake assembly by means of relative motion between the upper boot quarter and the skate frame.

Yet another object of the present invention is to provide a hand held transmitter which can actuate the brake assembly.

Still yet another object of the present invention is to simultaneously actuate brakes on a plurality of skate wheels.

A hinge motion is used to bring a brake pad into contact with a wear surface attached to or integral to the hub of a wheel of a skate.

The preferred embodiment uses backwards rotation of a hinge at or near the ankle of a two-piece boot to activate the brake. A single activating link connects the upper portion of the boot to a brake pad support member(s). This activating link is hinged to the brake pad support member, and may be either hinged or directly connected to the upper portion of the boot. The opposite end of the brake pad support member is hinged to the skate frame or an attachment to the frame.

The preferred embodiment places the hinge which connects the brake pad support member to the frame forward along the wheel hub of the hinge with the activating link. The forward direction along the wheel hub is here defined by the direction of rotation of the wheel(s) when the skate is rolling forward. This results in a mechanical advantage or self-assisting application force for the brake where the friction force between the brake pad and the hub tends to further engage the brake pad (rather than driving it away), thereby reducing the required activating force for the brake.

The preferred embodiment places the brake pad support member adjacent to the surface of the wheel hub nearest the ground. This, in combination with the two above features results in a very compact design having few parts in which the activating link is very close to the boot. No part of the brake mechanism extends behind the rear wheel.

In an alternate embodiment, the brake pad can be brought into contact with the wear surface of the hub via a hand-held activator by means of a cable or an electronic means such as a radio transmitter. A receiver attached to the skate frame would then activate an electric actuator (solenoid, gearmotor, etc.) to activate the brake. Such electric actuators are well known to those skilled in the art. In this case, the mechanical advantage discussed above is very important, as it greatly reduces the power requirements of the actuator.

Spring means are included to hold the brake pad(s) away from the hub surface when the brake is not activated. The spring means can be positioned at any convenient location, such as at the fixed hinge connecting the brake pad support member to the frame, or within the actuation means.

A single brake pad can be used on either side of the wheel(s), or two brake pads can be used, one on either side of the wheel(preferred).

Brake pad(s) can be used on a single wheel or a multiple wheel embodiment.

Other objects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
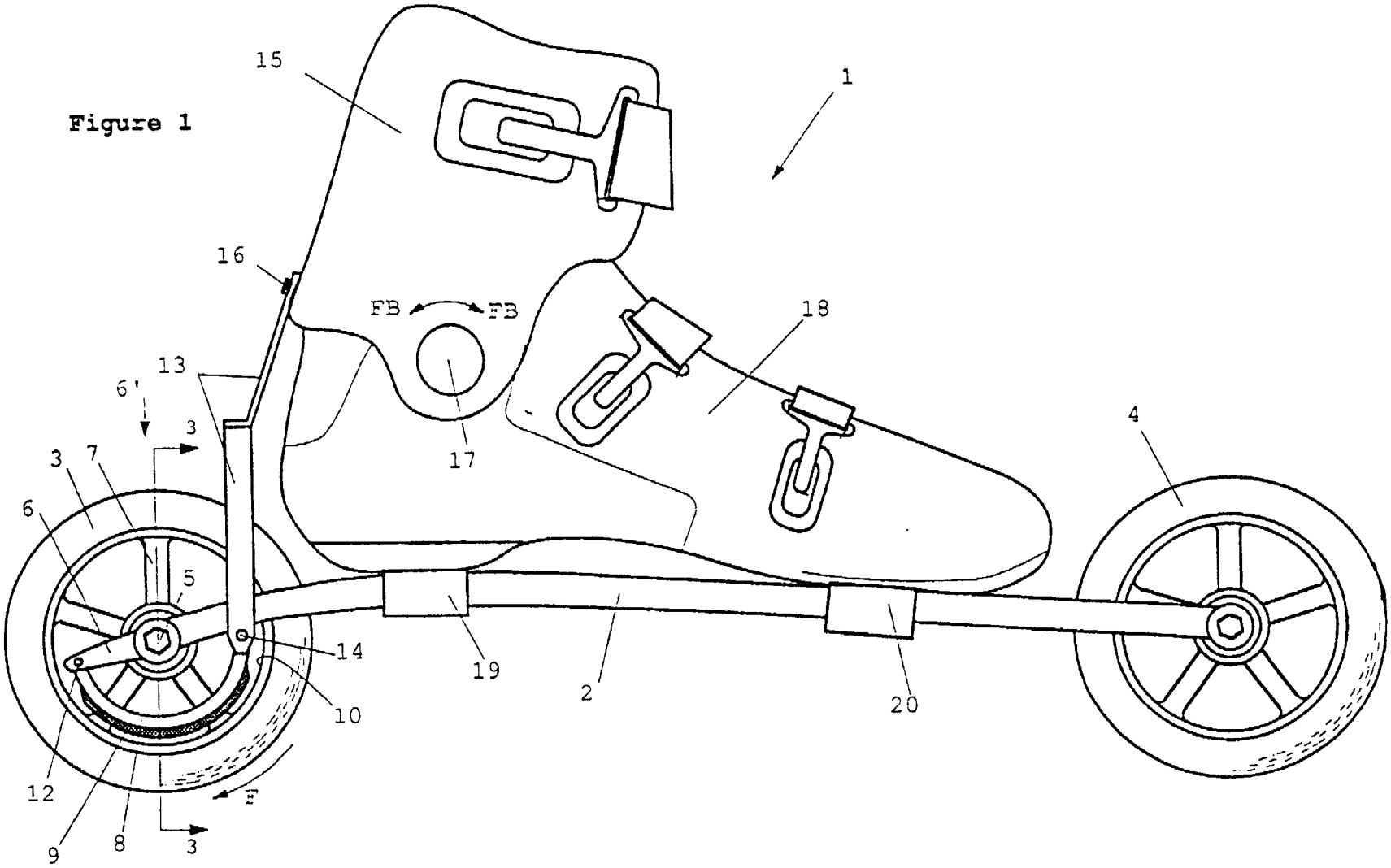
FIG. 1 is a right side plan view of a two wheel in-line skate having the preferred embodiment of the drum type brake on the rear wheel.

Referring first to FIG. 1, an in-line skate 1 has a frame 2 which supports wheels 3,4. Rear axle 5 is supported by frame ends 6 and 6' (not shown). A support hub 7 rotates about the axle 5. Boot 18 is secured to frame 2 by mounting blocks 19 and 20.

The preferred embodiment of the brake assembly is shown to consist of a brake shoe 8 having a brake pad 9. The pivot planes P2 and P2' of the brake shoe 8 are parallel to the central plane P1 of the wheel 3. See FIG. 3. Brake pad 9 is preferably composed of automotive type brake pad material. It is attached to the brake shoe 8 by means of an adhesive and may be molded directly onto brake shoe 8.

Figure 3:
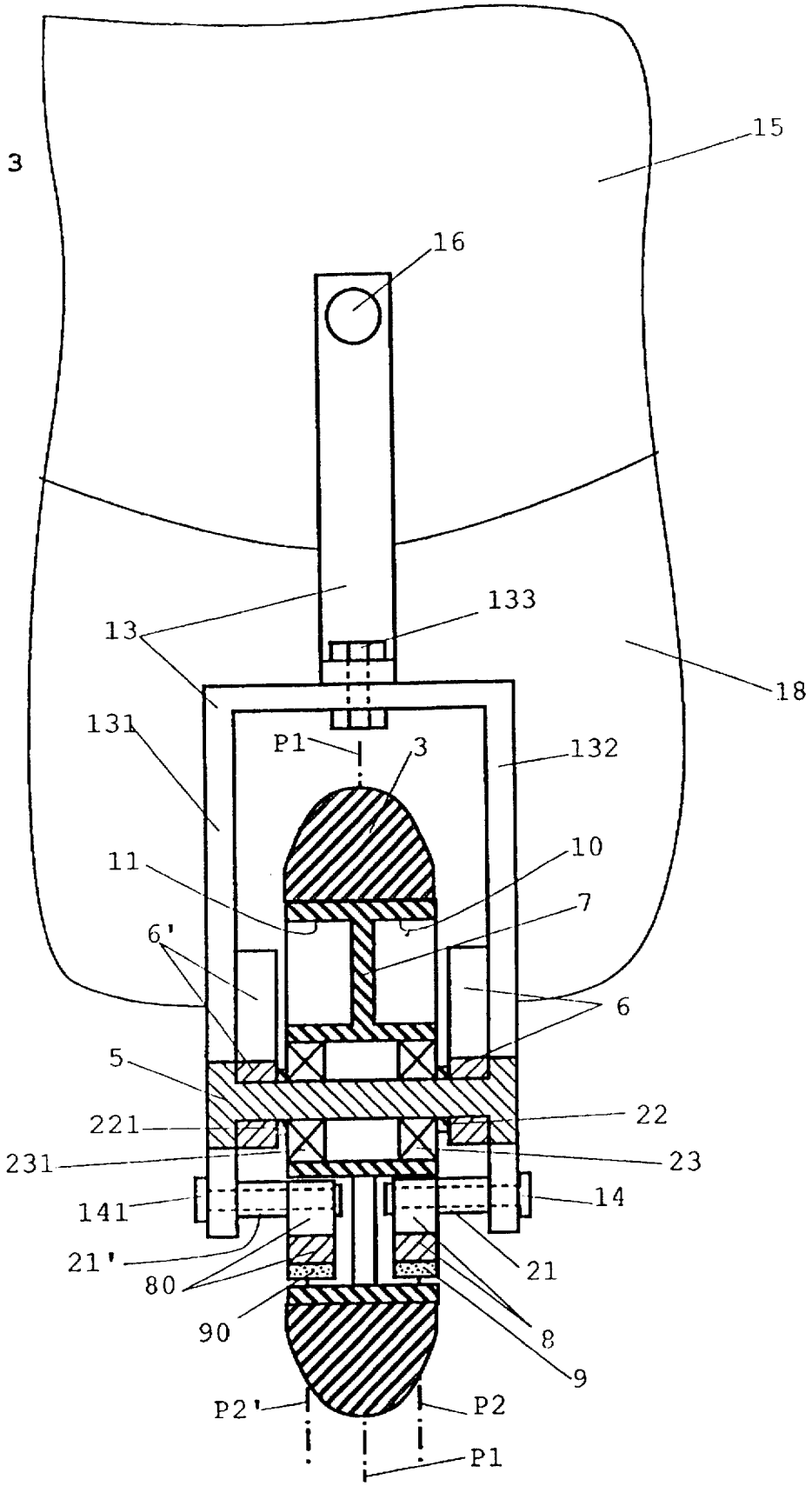
FIG. 3 is a sectional view taken along line 3—3 of FIG. 1.

At least one inner race of the wheel 3 includes a circular braking surface 10. FIG. 3 shows the preferred embodiment having two circular braking surfaces 10,11 and two brake pads 9,90. The circular braking surfaces 10,11 are located at the inside of the outer periphery of the wheel 3 in order to make the size of the brake pad(s) 9,90 as large as possible. The inside of the outer periphery of the wheel 3 is the support hub 7.

The brake shoe 8 is pivotally affixed to the frame 2 by a fixed hinge 12 which has a central axis parallel to the axle 5. Fixed hinge 12 is located behind axle 5 in relation to the skate 1 moving forward. Also brake shoe 8 pivots downward to engage the brake pad 9 against the circular braking surface 10. In this manner, during braking, the forward rotation F of the wheel 3 tends to rotate the brake pad 9 in the same direction F. This results in a force on brake pad 9 which adds to the braking force. Thus, a minimal force on activating link 13 is required to activate the braking assembly 13, 6, 8, 9, 10.

Activating link 13 is pivotally attached to the brake shoe 8 at activating hinge 14. The top of activating link 13 is affixed to boot quarter 15 with a fastener 16. Boot quarter 15 hinges around boot 18 at hinge 17 as indicated by arrows FB. Thus, in order to stop, the skater pushes the braking foot forward and/or leans backwards, thereby pushing activating link 13 downward. The brake shoe 8 and brake pad 9 are pushed against the circular braking surface 10. In FIG. 3 optional spacers 21, 21' are shown between the activating link 13 and the brake shoes 8 and 80. The activating link 13 is seen to have lower prongs 131, 132 and may include a fastener 133.

Axle spacers. 22, 221 prevent the frame ends 6, 6' from binding on bearings 23, 231. The width of these spacers can be increased in order to allow brake surfaces 9, 10 to extend beyond the width of the wheel 3, thereby increasing the area of the braking surface.

In this embodiment, if all parts are perfectly rigid, fastener 16 must be a hinge W axis parallel to the wheel axis 5. However, slight flexing of boot quarter 15 and activating link 13 allows the braking system to perform well using a mechanical fastener at 16.

Although the preferred embodiment shows two brake shoes 8, 80, a single brake shoe system (not shown) will function. One equivalent to a hinged upper boot is taught in U.S. Pat. No. 4,281,468 which is incorporated herein by reference. FIG. 3 shows a bellows style flexible upper boot which would be a design choice for the present invention.

Figure 2:
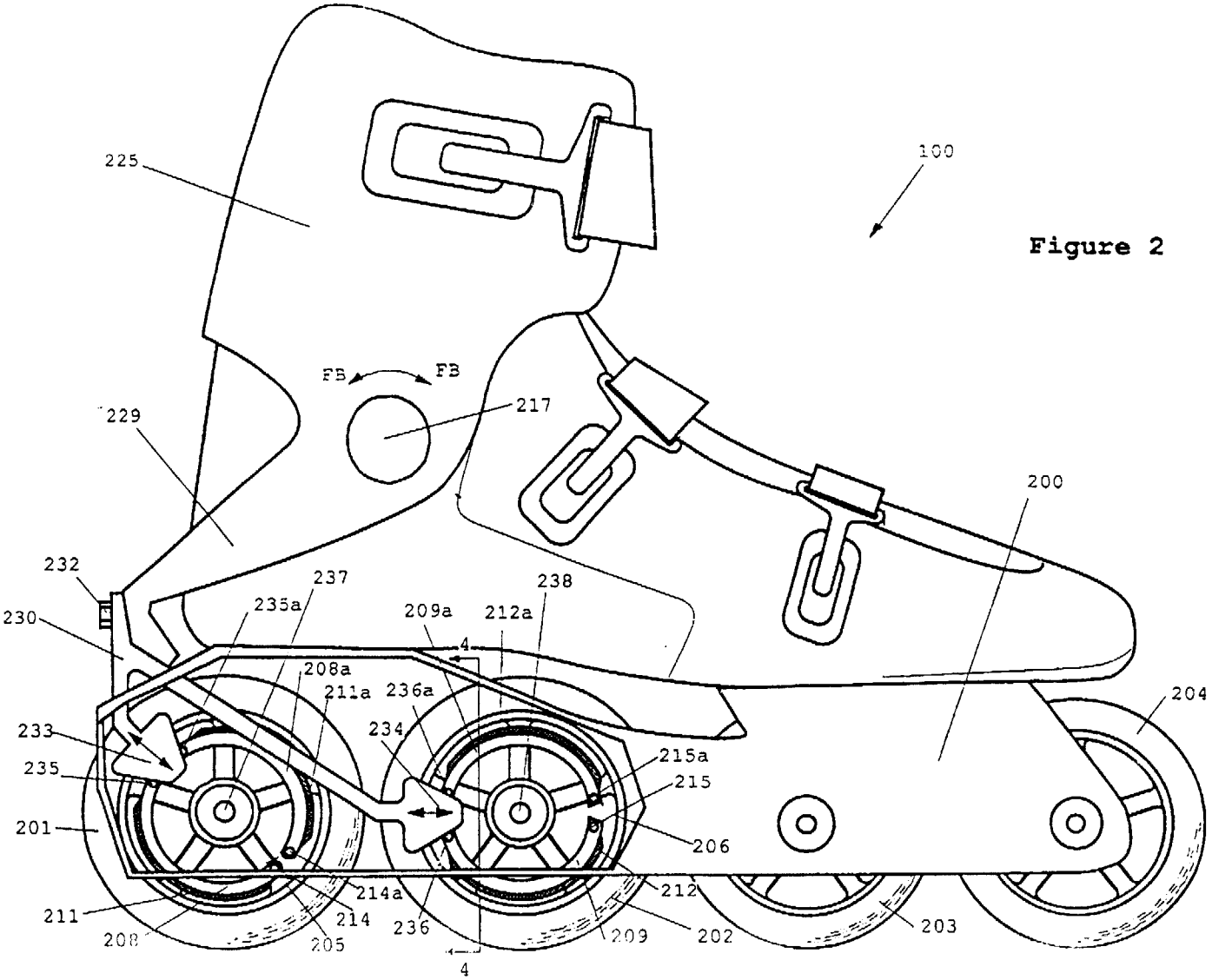
FIG. 2 is an alternate embodiment showing a right side plan view of a multi-wheel skate having multiple brakes.

Referring next to FIG. 2, a skate 100 has a frame 200 which supports wheels 201, 202, 203, 204. The wheels 201 and 202 have circular braking surfaces 205, 206. Dual brake shoes 208, 208*a*, 209, 209*a*have brake pads 211, 211*a*, 212, 212*a*. Brake shoes 208, 208*a*, 209, 209*a*are supported by fixed pivot ends 214, 214*a*, 215, 215*a*.

Upper boot quarter 225 includes a rearward extension 229. Activating link 230 is fixedly attached to extension 229 via fastener 232. Activating link 230 supports cam ends 233,234, one for each brake wheel. Slot-like guides (not shown) can be included in the frame to support activating link 230 against lateral and/or torsional movement. Brake shoes 208, 208*a*, 209, 209*a*include posts 235, 235*a*, 236, 236*a* opposite their fixed pivot ends 214, 214*a*, 215, 215*a*. Backwards rotation of boot hinge 217 moves cam ends 233, 234 inward towards wheel axles 237, 238 and forces rods 235/235*a* and 236/236*a* apart, thereby pressing brake pads 211/211*a*and 212/212*a* against circular braking surfaces 205, 206.

Figure 4:
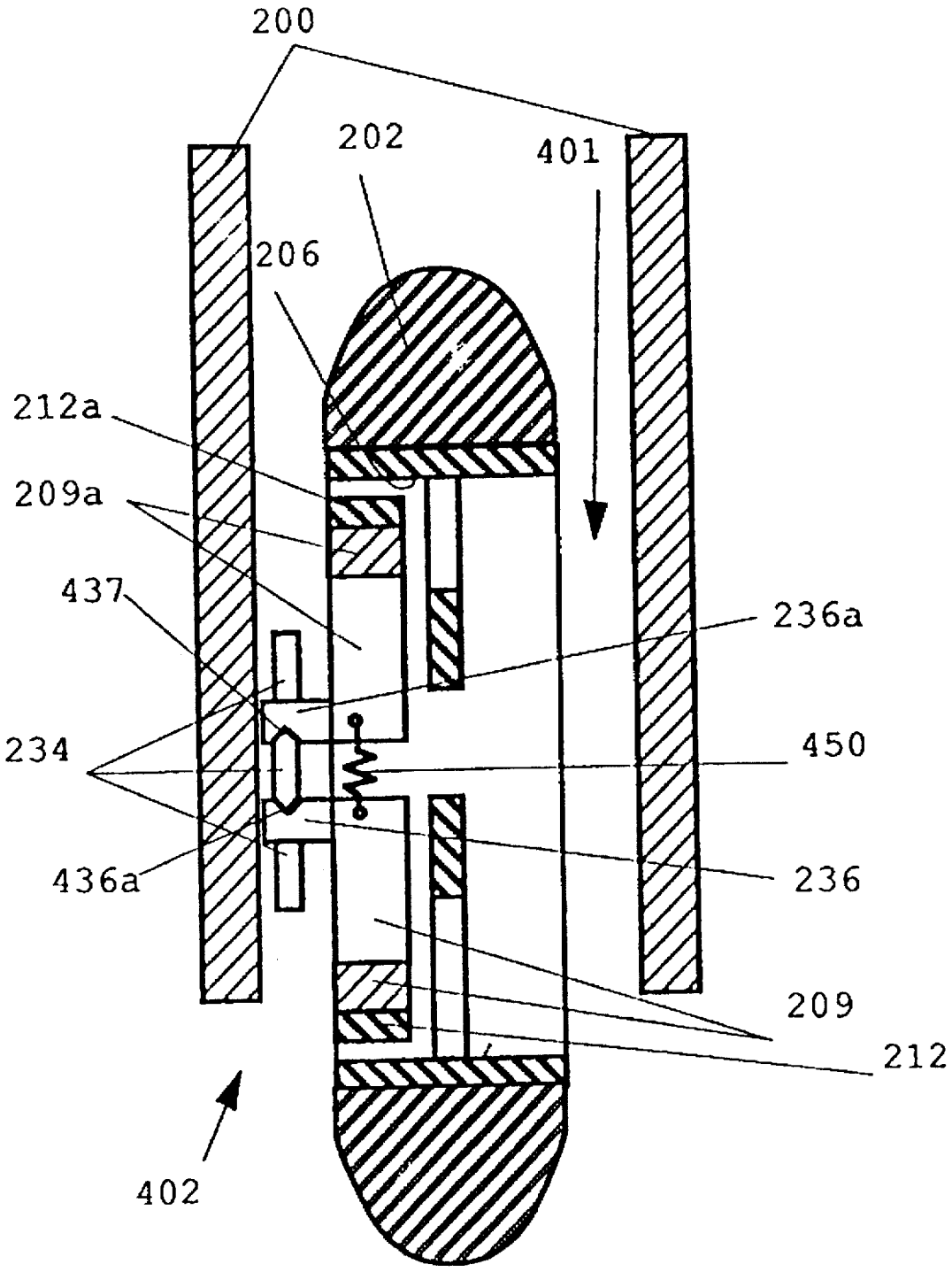
FIG. 4 is a sectional view taken along line 4—4 of FIG. 2.
Figure 10:
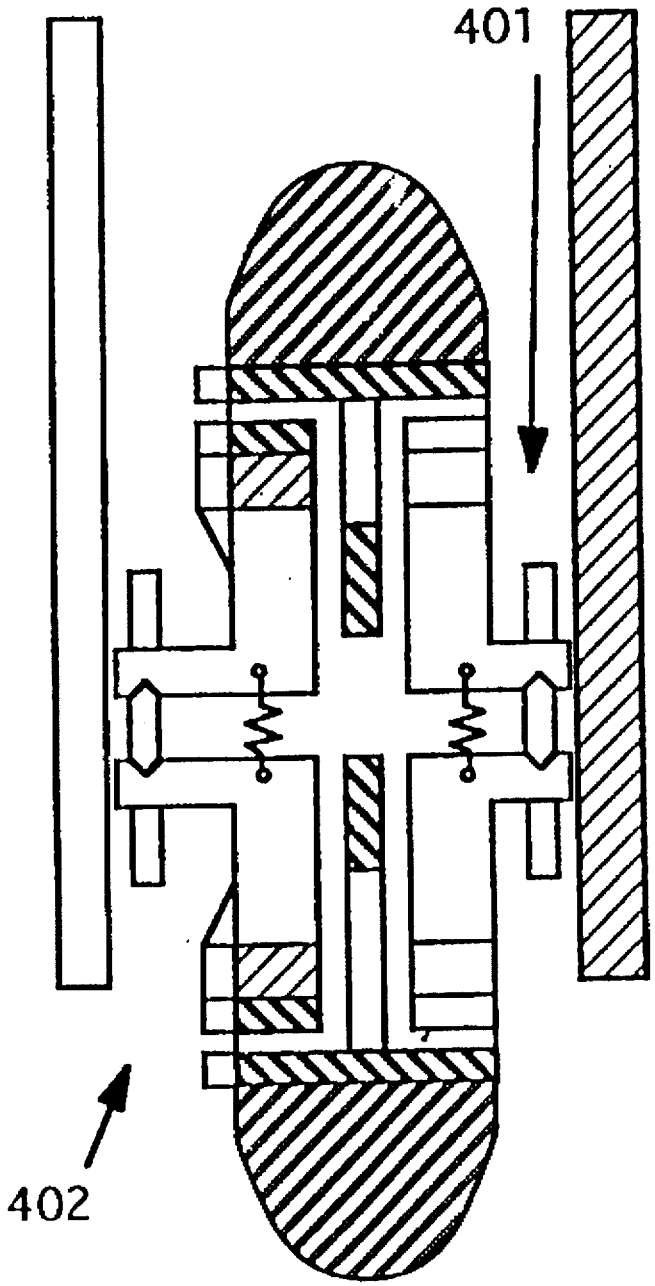
FIG. 10 is a sectional view of an alternate embodiment of FIG. 4 showing a dual circular braking surface having a quadruple brake shoe assembly.

As shown in FIG. 4, posts 236, 236*a* can include slots 437, 436*a* to constrain and support cam end 234. A return spring 450 may be included as shown or elsewhere to urge posts 236, 236*a* towards each other to disengage the brake when cam end 234 is retracted. FIG. 10 also shows in lines 401 how the brake mechanism can be used on both sides of wheel 2020, if preferred. Also, in lines 402 it is shown how all components of the brake system at the wheel can be extended beyond the width of the wheel 2020 in order to increase the surface area of the brake. This would require that the frame be widened to accommodate the wider brake.

It can be seen that the skater can activate the brakes by backward rotation of the boot hinge to apply brakes on multiple wheels simultaneously with this embodiment.

Figure 5:
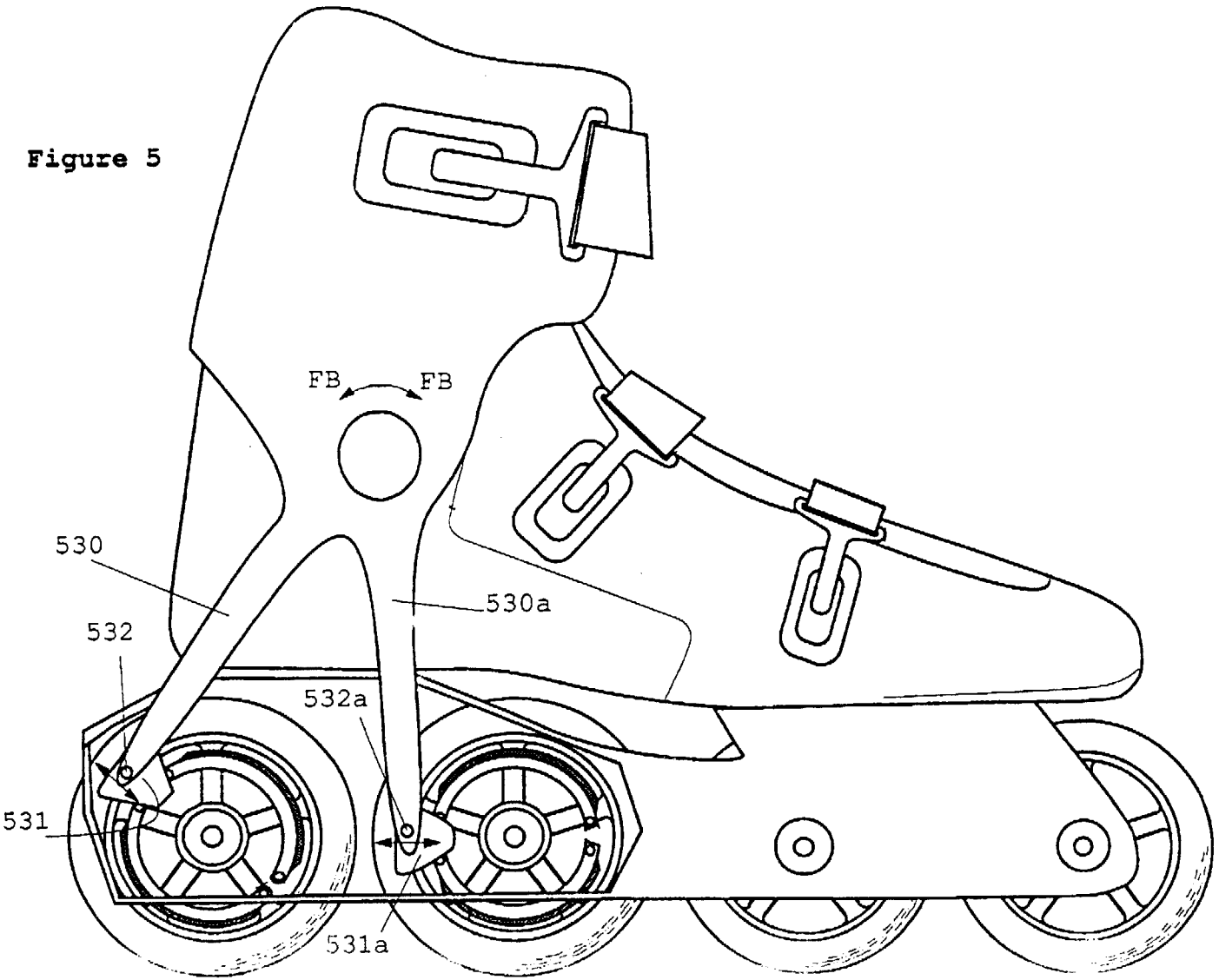
FIG. 5 is a right side plan view of an alternate embodiment having two lever type brake actuators extending from a swivel top of a boot.
Figure 6:
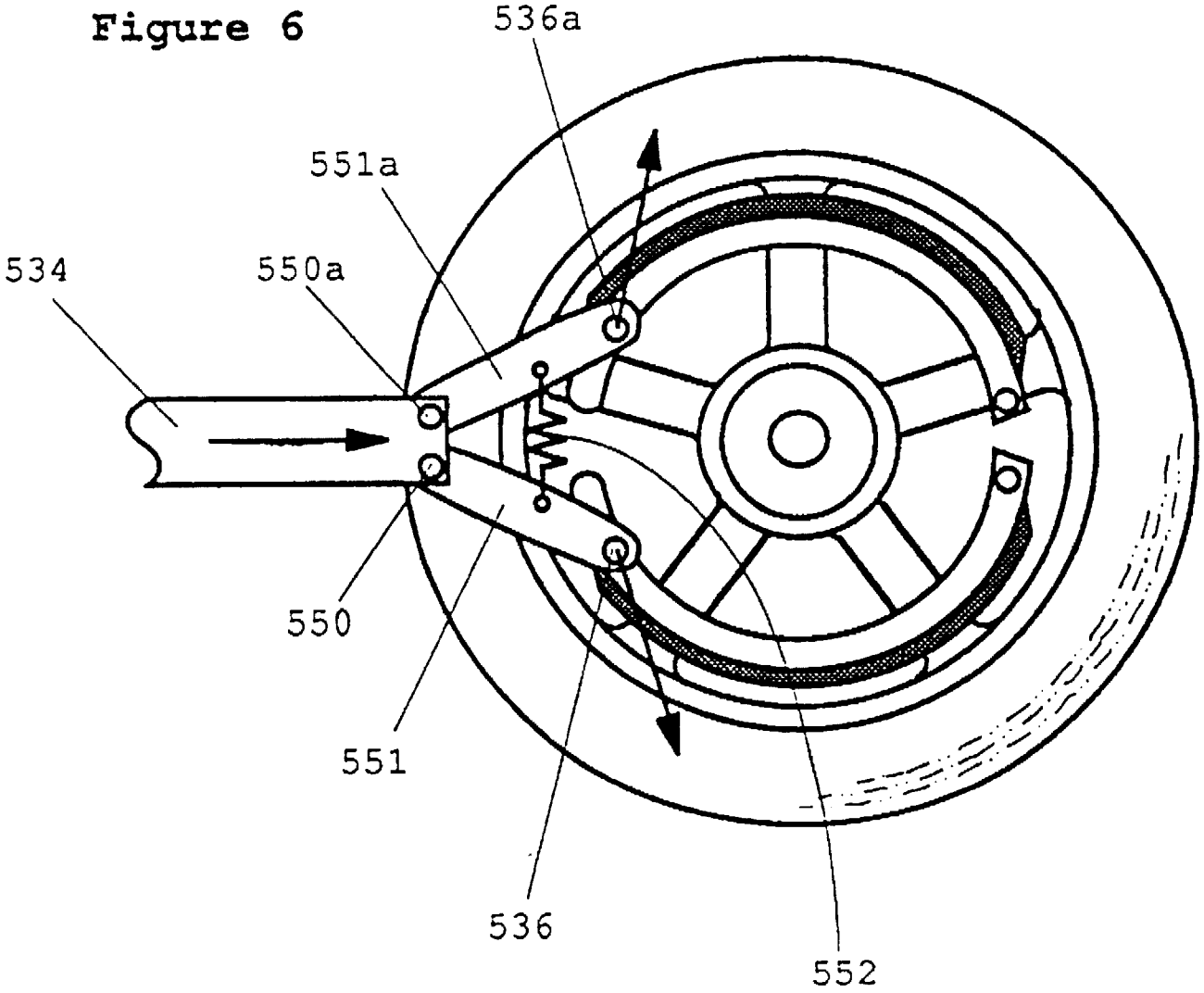
FIG. 6 is a close up right side plan view of an alternate embodiment of a brake actuator.

FIG. 5 shows an alternate embodiment of the brake system of FIG. 2. Separate upper boot quarter extensions 530, 530*a* directly drive cams 531, 531*a* via connections 532, 532*a*. FIG. 6 shows an alternate embodiment of the brake mechanism at the wheel of either FIG. 2 or FIG. 5. Cam end 234 of FIG. 2 is replaced with link end 534 which includes hinges 550, 550*a*. Posts 236, 236*a* of FIG. 2 are adapted to serve as hinges 536 and 536*a*. Short links 551, 551*a* connect hinges 550/536 and 550*a*/536*a*. This embodiment uses hinges rather than sliding surfaces, thereby reducing friction and wear. Optional return spring 552 again serves to disengage the brake when link end 534 is retracted.

Figure 7:
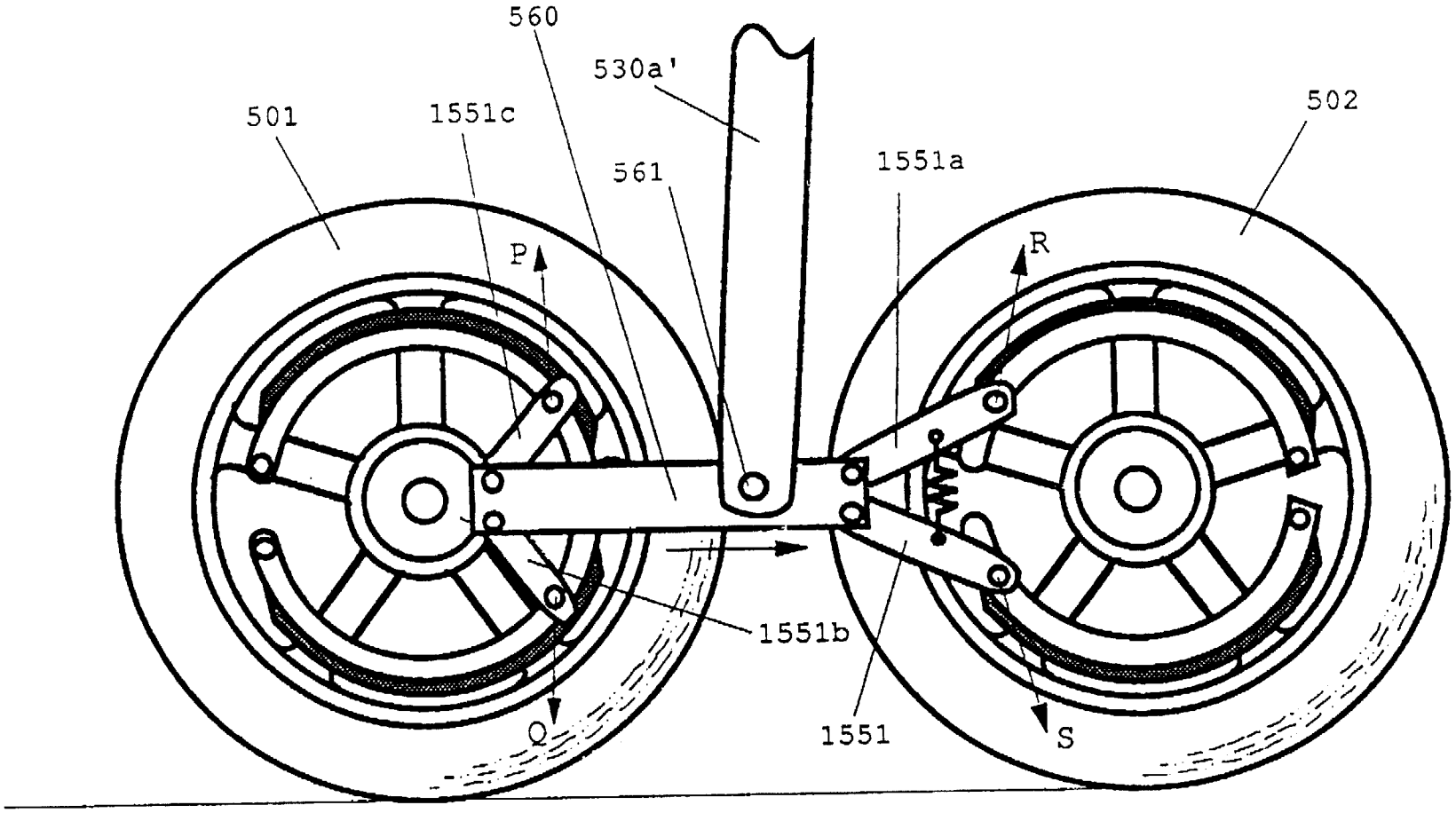
FIG. 7 is a close up right side plan view of an alternate embodiment of a brake actuator for a two wheel brake assembly.

FIG. 7 shows an alternate embodiment wherein a single extension of the upper boot quarter 530*a'* between wheels activates brakes on two or more wheels via link 560. Link 560 is attached to extension 530*a'* via fastener or hinge 561, and hinged to short links 1551, 1551*a*, 1551*b*, 1551*c*. Arrows P, Q, R, S indicate the direction of motion of the moving hinges when activating the dual wheel brakes.

Figure 8:
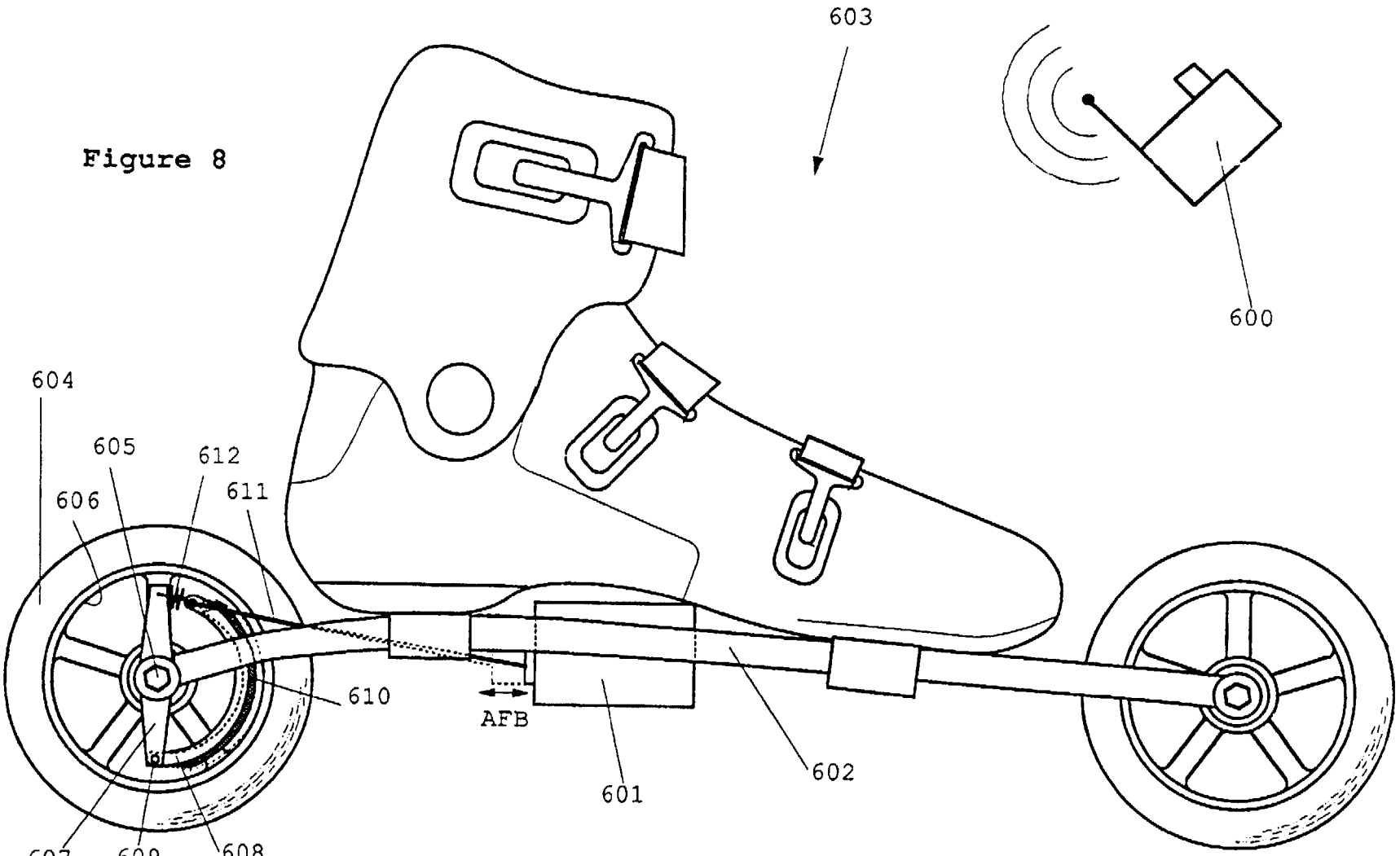
FIG. 8 is a right side plan view of an alternate embodiment having an electronic actuator mounted under the boot.

FIG. 8 shows another alternate embodiment wherein a remote transmitter 600 triggers an actuator 601 which is affixed to frame 602. The skate 603 may or may not have a hinged upper quarter. The transmitter 600 is preferably hand held. The actuator 601 is a gear motor drive. It could also be a solenoid or other known mechanism capable of achieving the forward and backward motion indicated by arrows AFB.

The frame 602 supports rear wheel 604 at axle 605. The wheel 604 has a circular braking surface 606. A frame extension arm 607 supports the brake shoe 608 at fixed hinge 609. Brake shoe 608 has a brake pad 610. The actuator 601 pulls the cable or linkage 611 which pressed the brake pad 610 into the circular braking surface 606. A return spring 612 returns the brake shoe 608 to a neutral position when the actuator 601 releases.

Figure 9:
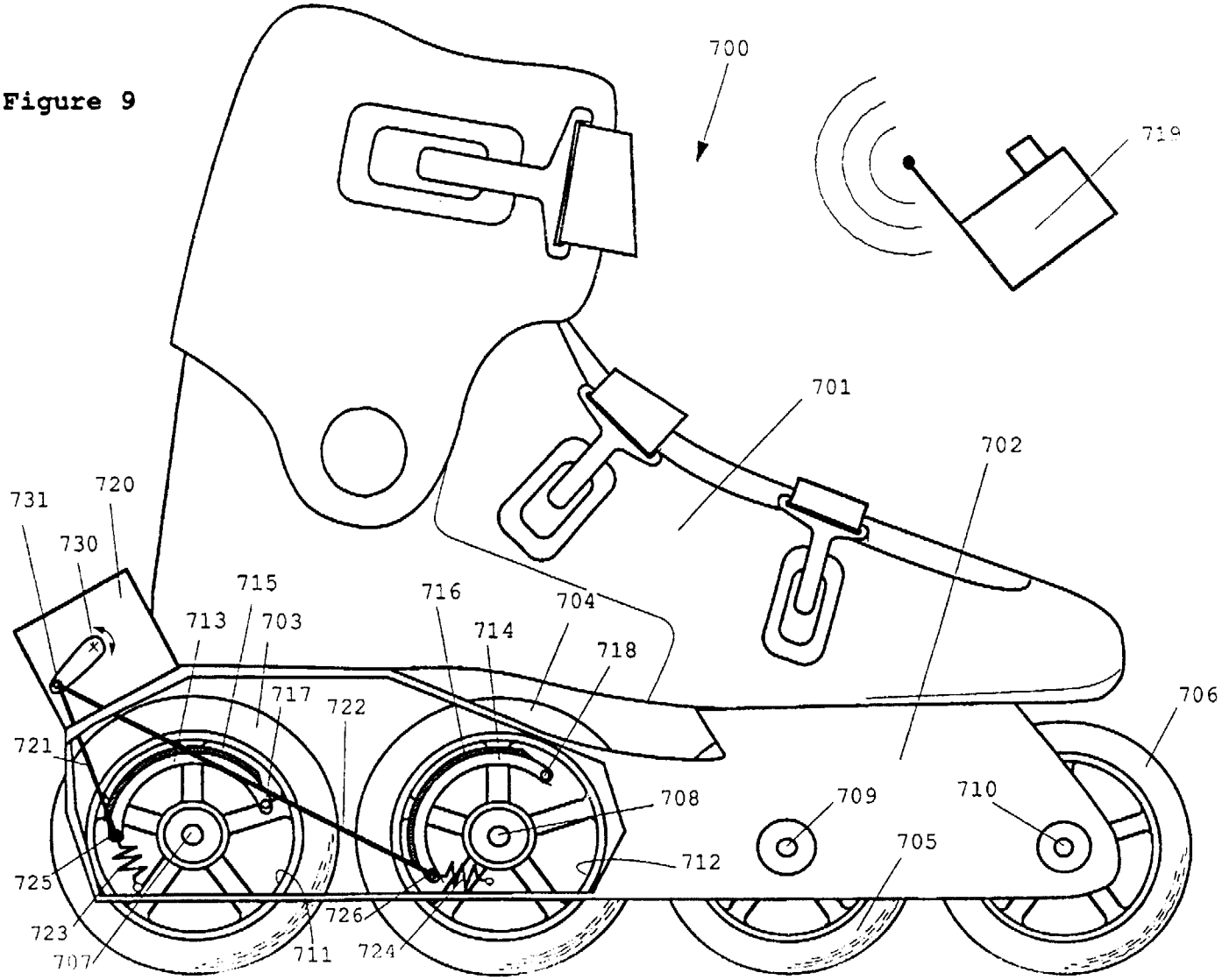
FIG. 9 is a right side plan view of an alternate embodiment having an-electronic actuator mounted at the heel of a boot and actuating a plurality of brake assemblies on a plurality of wheels.

Referring next to FIG. 9, a skate 700 has a boot 701 mounted on a frame 702. The frame 702 supports wheels 703, 704, 705, 706 by means of axles 707, 708, 709, 710. Wheels 703, 704 have circular braking surfaces 711, 712 respectively. Brake shoes 713, 714 have brake pads 715, 716. Brake shoes are affixed to the frame by hinges 717, 718.

A transmitter 719 is preferably hand held. It activates the actuator 720 which is affixed to the frame 702. Via cable or linkage 721, 722 the actuator 720 presses the brake pads 715, 716 into the circular braking surfaces 711, 712. Return springs 723, 724 return the brake shoes 713, 714 to the neutral position after actuation.

FIG. 9 shows an alternate embodiment for actuator 720 in which rotary motion about pivot 730 is used with an eccentric connection 731 to linearly displace the brake shoes 713, 714 at connections 725, 726.

The braking force can be controlled by controlling the force applied by the actuator. This is readily achievable in the case that the actuator is a gearmotor, for example, by controlling the voltage applied to the motor. Similarly, the applied force may be controlled by using an elastic cable for the actuating cables (611 in FIG. 8, 721, 722 in FIG. 9). The spring rate of the cable converts movement of the solenoid into a braking force.

Although the present invention has been described with reference to preferred embodiments, numerous modifications and variations can be made and still the result will come within the scope of the invention. No limitation with respect to the specific embodiments disclosed herein is intended or should be inferred.

We claim:

1. A skate wheel brake comprising:

a boot rigidly mounted on a frame to reduce relative movement of said boot and said frame;

a wheel on the frame having a radially inwardly facing surface;

said radially inwardly facing surface further comprising a braking surface;

a brake shoe having a brake pad;

said brake shoe further comprising a pivoting end having a hinged attachment to a support means, thereby holding the brake pad juxtaposed the braking surface;

said brake shoe pivoting in a plane parallel to a central plane of the wheel; and said brake shoe further comprising an activating end having a pivotal attachment to an activator means, whereby the activator means controllably moves the activating end toward and away from the braking surface, thereby generating a braking force on the wheel when they brake pad presses against the braking surface.

2. The brake of claim 1, wherein said support means comprises a frame extension member.

3. The brake of claim 1, wherein said activator means further comprises an upper boot pivot means and a linkage interconnecting said upper boot pivot means and said activating end of said brake shoe, wherein a rearward rotation of the upper boot pivot means presses the linkage and the brake shoe so as to force the brake pad against the braking surface.

4. The brake of claim 1, wherein said hinged attachment to the support means is disposed such that a forward rotation of the wheel in combination with activation of said braking pad against said braking surface increases the force of the brake pad against the braking surface.

5. The brake of claim 3, wherein said radically inwardly facing braking surface further comprises a first and a second braking surface, said support means further comprises a first and a second mounting member, and said linkage further comprises a first and a second depending member, said first depending member having an attachment to a first brake shoe, said second depending member having an attachment to a second brake shoe and said first and second brake shoes each having a pivoting end attached to the respective first and second mounting member.

6. The brake of claim 1 wherein said hinged attachment and said activating end are positioned relative to the axle of said wheel to create a self assisting application force between said brake pad and said braking surface when the brake is applied.

7. The brake of claim 1, wherein said hinged attachment is located rotationally forward with respect to a wheel axle of said activating end, so that pressing said brake pad against said braking surface when said wheel is rotating in a forward direction results in a force which further presses said brake pad against said braking surface.

8. A drum brake for an in-line skate having a plurality of wheels, said wheels having axles which are supported by a frame, said drum brake comprising:

at least one wheel having a radially inwardly facing braking surface, said braking surface generally comprising a circular braking surface;

a brake shoe having a pivotal mounting means and having a pivot plane substantially parallel with a central plane of the wheel;

said brake shoe having a brake pad and an activating end; and an actuator means pivotally mounted to and functioning to press the activating end toward said circular braking surface, thereby causing the brake pad to apply a braking force to the wheel.

9. The drum brake of claim 8, wherein the actuator means further comprises a rotatable upper member of a boot and a linkage interconnecting said upper member and said activating end of said brake shoe, wherein a rearward rotation of the upper member of the boot causes the brake pad to apply a braking force to the wheel.

10. The drum brake of claim 8, wherein the pivotal mounting means is disposed such that a forward rotation of the wheel urges the brake pad against the circular braking surface during braking.

11. The drum brake of claim 9, wherein the pivotal mounting means further comprises a fixed hinge on a frame member.

12. A skate wheel brake comprising:

a boot rigidly mounted on a frame to substantially prevent relative movement of said boot and said frame;

at least two wheels having tires disposed on said frame, at least one of said wheels having a radially inward facing braking surface;

said radially inward facing braking surface disposed at least partially within the width defined by the tire of said wheel;

a brake shoe having a brake pad;

said brake shoe comprising a pivoting end hingedly attached to a support means, thereby holding the brake pad juxtaposed said radially inward facing braking surface, and an activating end pivotally attached to an activator means;

said brake shoe pivoting in a plane substantially parallel to a central plane of the wheel;

whereby the activator means controllably moves the activating end toward and away from said radially inward facing braking surface to apply the brake pad to at least a portion of the braking surface within the width of the tire, thereby generating a braking force on the wheel.

13. The brake of claim 12, wherein said radially inward facing braking surface is disposed substantially within the width defined by the tire of said wheel.

14. The skate brake of claim 12 wherein said wheels have a width no greater than the width of said tires.

15. The skate brake of claim 12 wherein said radially inwardly facing braking surface is substantially disposed within a width defined by a tire of said wheel.

16. A skate wheel brake comprising:

a boot mounted on a frame;

a wheel on the frame having radially inwardly facing surface;

said inwardly facing surface further comprising a braking surface;

a brake shoe having a brake pad;

said brake shoe further comprising a pivoting end having a hinged attachment to a support means, thereby holding the brake pad juxtaposed the braking surface;

said brake shoe pivoting in a plane substantially parallel to a central plane of the wheel; and said brake shoe further comprising an activating end pivotally attached to an activator means, whereby said hinged attachment and said activating end are positioned relative to the axle of said wheel to create a mechanical advantage between said brake pad and said braking surface when the brake pad presses against the braking surface which reduces the amount of activating force needed to stop the wheel.

* * * * *